United States Patent [19]

Ristvedt et al.

[11] 4,086,928

[45] May 2, 1978

[54] COIN SORTING MACHINE

[76] Inventors: Victor G. Ristvedt, Rte. 6; Roy B. Johnson, Rte. 6, Belmar Cir., both of Manchester, Tenn. 37355

[21] Appl. No.: 712,187

[22] Filed: Aug. 6, 1976

[51] Int. Cl.[2] ..... G07D 3/00

[52] U.S. Cl. ..... 133/3 A

[58] Field of Search ..... 133/3 R, 3 A

[56] References Cited

U.S. PATENT DOCUMENTS

| | | | |
|---|---|---|---|
| 2,906,276 | 9/1959 | Blanchette et al. | 133/3 R |
| 2,977,961 | 4/1961 | Buchholz et al. | 133/3 R |
| 3,998,237 | 12/1976 | Kressin et al. | 133/3 A |

*Primary Examiner*—Allen N. Knowles
*Attorney, Agent, or Firm*—C. A. phillips

[57] ABSTRACT

A coin sorting machine in which coins are moved by centrifugal force in a single layer and in a single file onto a flexible mat and laterally against an outer raised edge of a rotating disc. The coins are then rotated under a series of coin depressors, each being spaced to engage the inner edge of a particular diameter, denomination, of coin at a discrete peripheral position. As the inner edge of a particular coin is thus depressed into the flexible mat, the outer edge of that coin is raised above the outer restraining edge, and the coin is thus hurled outward above the edge at a discrete peripheral position to thus effect denominational sorting.

12 Claims, 7 Drawing Figures

COIN SORTING MACHINE

BACKGROUND OF THE INVENTION

1. Field of the Invention

This invention relates to coin sorting machines.

2. General Description of the Prior Art

The denominational sorting of coins is a substantial chore for handlers of coins, particularly banks and vending machine companies. In view of the tremendous volume of coins which are sorted, it is quite obvious that for a machine to adequately meet their needs, the machine must be capable of high-speed operation. Further, it must be tolerant to a variation of coin thicknesses and be relatively jam-proof. With respect to speed, sorting speeds of known devices are in the range of 1,500 to 2,500, and at this time the applicants have been advised that much higher speeds, ideally in the range of 6,000 to 8,000, are much needed.

It is the object of the present invention to provide a new and improved coin sorting machine which does provide substantially higher speeds of sorting, and yet is relatively jam-free and reliable.

SUMMARY OF THE INVENTION

In accordance with the invention, and with reference to a sorter of the general configuration disclosed in U.S. Pat. No. 2,906,276 wherein one of the present applicants is a co-inventor, it is to be noted that a coin is sorted by lifting the inner edge, enabling it to be hurled centrifugally over a peripheral limit at a discrete peripheral location and thus be sorted. With this sorter, sorting speeds in the range of 1,500 to 2,500 have been achieved. In accordance with the present invention, instead of raising the inner edge of a coin to enable it to be "sorted out", means are provided to do the opposite—depressing the inner edge into a flexible mat and thereby causing the outer edge to raise, allowing the coin to be hurled outward over the edge of the machine without having to tumble, as is the case where the inner edge is raised. As a result, with the applicants' device, successful sorting speeds in the range of 7,500 to 8,000 have been achieved.

DETAILED DESCRIPTION OF THE DRAWINGS

Figure 1:
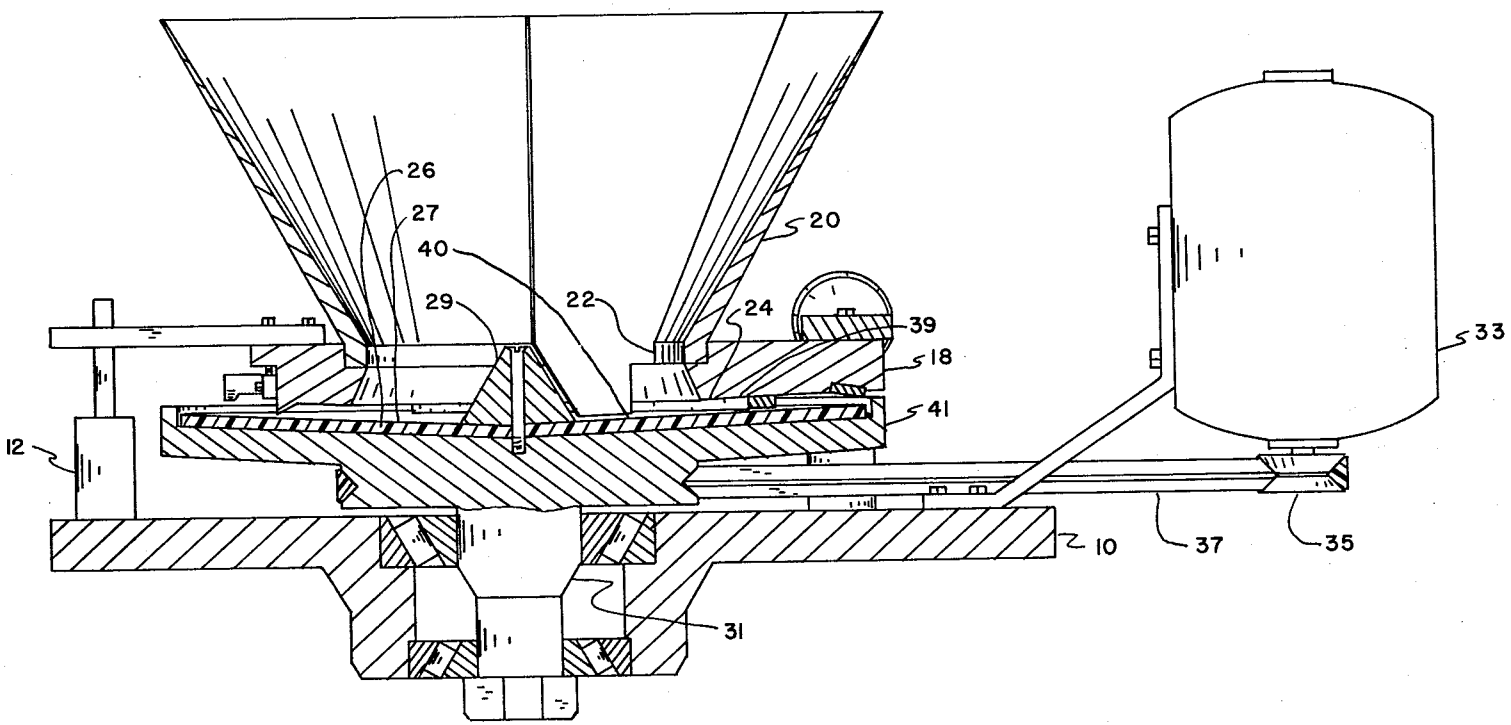
FIG. 1 is a side view partly in section of an embodiment of the invention.
Figure 2:
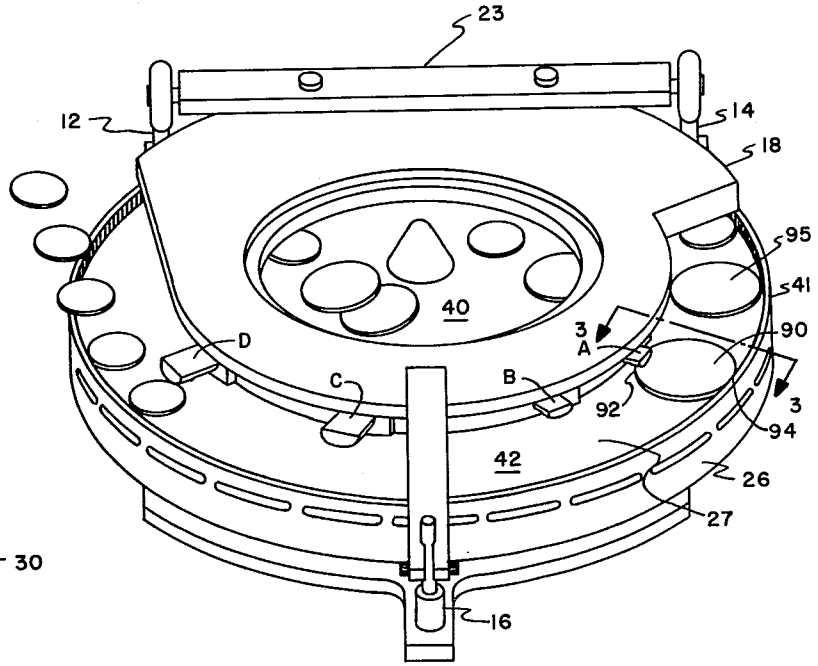
FIG. 2 is a perspective view of the basic portion of an embodiment of the invention.

Referring to FIGS. 1 and 2, the coin sorter shown therein includes mounting base 10, upon which upright supports 12, 14, and 16 are attached. An arcuate plate or flange 18, which supports hopper 20 and effects guidance on coins to be sorted, is supported by these supports through arm 23 in the case of supports 12 and 14. Flange 18 includes a round tapered opening 22, to which is secured vertically positioned hopper 20 (FIG. 1). The lower or bottom surface 24 of flange 18 is tapered downward (from outside to inside) at an angle of approximately 4° to conform with the like taper on circular disc 26. This taper is provided to more perfectly hold coins down on the surface of the disc when they reach the edge. The upper surface 27 of disc 26 is formed of a resilient rubber pad 30 of 0.2 to 0.6 inch in thickness and a resilience of 6 to 10 durometers. A round or tapered knob 29 is positioned in the center of disc 26 concentric with hopper 20 in order to prevent a coin from remaining in the center of the disc. Disc 26 is rotably supported, by means not shown, in hub 31, in turn supported by base 10, and disc 26 is driven by motor 33 through pulley 35 and belt 37. Disc 26 rotates clockwisde as shown by the arrow with a general spacing of approximately 0.80 to 1.25 inches from the relatively flat surface portion 24 of the lower surface of flange 18. As a particular feature of this invention, lower surface 24 of flange 18 includes coin guides or routers which are configured to facilitate a non-doubled, single file flow of coins from the central region 40 (just under hopper 20) of disc 26 outward to the outer peripheral region against rim 41 of disc 26. Actually, they are thus guided or routed to a sorting station or region 42 where the coins are engaged, one at a time, by coin depressing cams A-D (FIG. 2) and sorted in a manner to be described.

Figure 4:
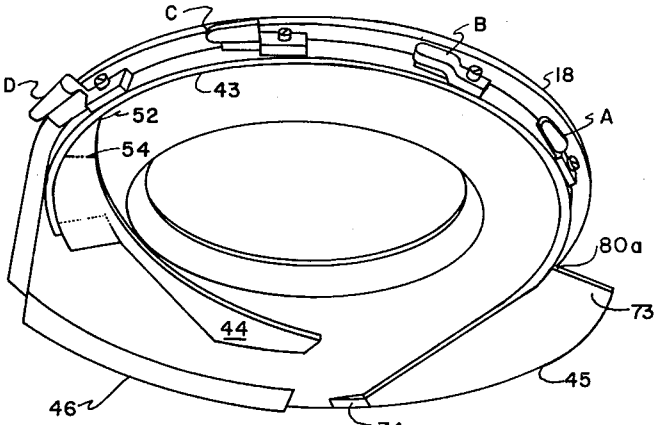
FIG. 4 is a perspective view generally illustrating the bottom portion of a coin guide plate.
Figure 5:
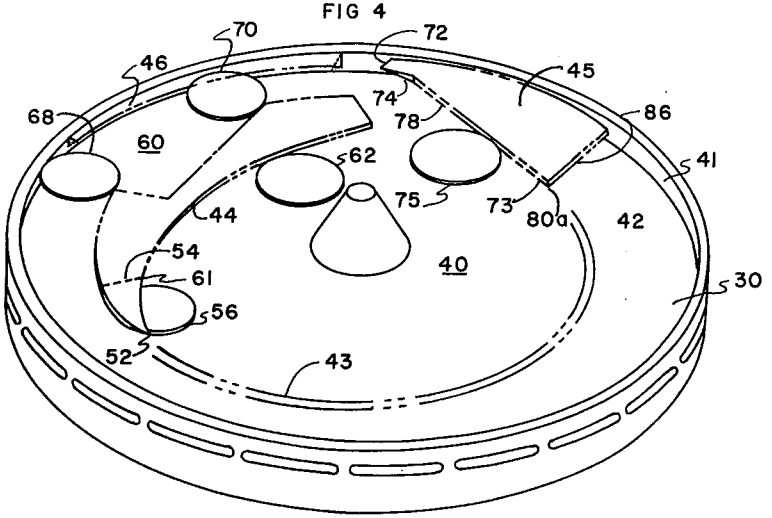
FIG. 5 is a perspective view showing the rotating disc employed by the invention and the relationship to it of guides held by the guide plate shown in FIG. 4.

Referring additionally to FIGS. 4 and 5, FIG. 4 illustrates the bottom side of flange 18, showing essentially four guides, 43, 44, 45, and 46, attached to the underside. FIG. 5 illustrates positioning of the guides alone positioned just above disc 26 and the movement of coins with respect to them. The leading edge region 48 of entrance guide 44, extending from point 52 to a line 54, is tapered on the underside to enable a coin, such as coin 56, which is initially against circular guide 43, to be captured under this guide and pass through to a coin alignment region 60 where most of the coins form a single file against rim 41. Coins which strike guide 44 at a point further around (clockwise) than a point 61 opposite line 54 see the full depth of guide 44 which extends down to within approximately 0.005 to 0.01 inch of the surface of pad 30 of disc 26, and they are directed back into the center region of disc 26 as illustrated in the case of coin 62.

Guide 45, which is wedge-shaped, captures coins, such as coins 68 and 70, which are against rim 41 of disc 26 and holds them in this radial position until they are engaged by guide 46 where they are captured by leading edge 72 of ramp 74 of guide 45. Ramp 74 tapers downward to depress the coins into pad 30, and thus enables them to continue in a stable position as they pass under guide 45 under the influence of an ascending ramp 73 to the trailing edge 86 of guide 45. The stabilizing effect is enhanced by the gradually tapered rise of ramp 73, causing the coins to remain in stationary engagement with the flexible surface or pad 30 of disc 26 as they emerge at sorting station 42. In the event that a coin is not positioned against rim 41 in alignment region 60, and thus inboard of the leading edge 78 of guide 45, a coin, such as coin 75, is directed back into the center region of disc 26 by virtue of the full height edge of guide 45 (beyond ramp 74) and the gap between guides 44 and 45. From point 80 guide 43 extends to point 52 to thus prevent any outward radial movement of coins in the center of disc 26 between these points. Thus, there is only a narrow passageway between point 52 and point 61 where a coin can actually exit, this thus substantially assuring that the coins are aligned in a single file once they reach rim 41, and, of course, as stated above, in the event that there is a doubling of coins beyond this exit, edge 78 will pick off the inside coin and return it to the center region of disc 26.

Figure 6:
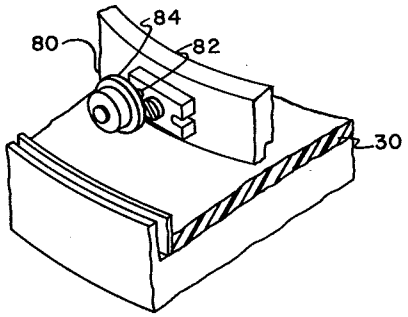
FIG. 6 is a perspective view of a modified form of the structure shown in FIG. 3.

FIG. 6 illustrates an alternate form for the coin depressors. As shown in this figure, they would be rollers, one being illustrated by roller 80 supported by shaft 82 upon flange 18. They may either be free to rotate when engaged by a coin or driven by an enlarged inner diameter 84 of a roller from pad 30.

Operation of the device is simple, with motor 33 running and disc 26 turning, clockwise as shown, coins are simply poured into the top of hopper 20. By the rotation of disc 26, a bottom layer of coins is effected which rests on rubber or otherwise flexible pad 30. These coins forming the bottom layer are forced outward from the center of the disc by centrifugal force. In the region from approximately points 80a to 52 (FIG. 4) they are restrained from radial outward movement, and thus are moved, by disc 26 until they either pass under the leading edge region of guide 44 and pass to alignment region 60; or if they are inboard of the position shown for coin 56, they are directed by the inner edge of guide 44 back into the center region of disc 26 as shown in the case of coin 62. Coins which do pass into region 60, such as illustrated by coins 68 and 70, and being against rim 41, are successively engaged by the leading edge, downwardly extending ramp regions of guide 45 which presses the coin into pad 30, stabilizing them, and holding them against rim 41 until they emerge at end 86 of guide 45 which is essentially the entrance of sorting station 42. It will be noted from FIGS. 4 and 5 that guide 45 has a gradually rising reverse ramp at its trailing edge which allows the coins to gradually rise to a level on top of pad 30, and thus the tendency toward vertical vibration is prevented, enabling the coins to be in a flat resting state when they are contacted by one of the coin depressors. As stated above, in the event that there does occur a coin which rests on the inner side of one of the coins against rim 41, and thus it is not engaged by the tapered leading edge 72 of guide 45, that coin will be engaged by the full height edge 74 of guide 45, and would be redirected back into the center of disc 26 as may be deemed the case for coin 75.

Figure 3:
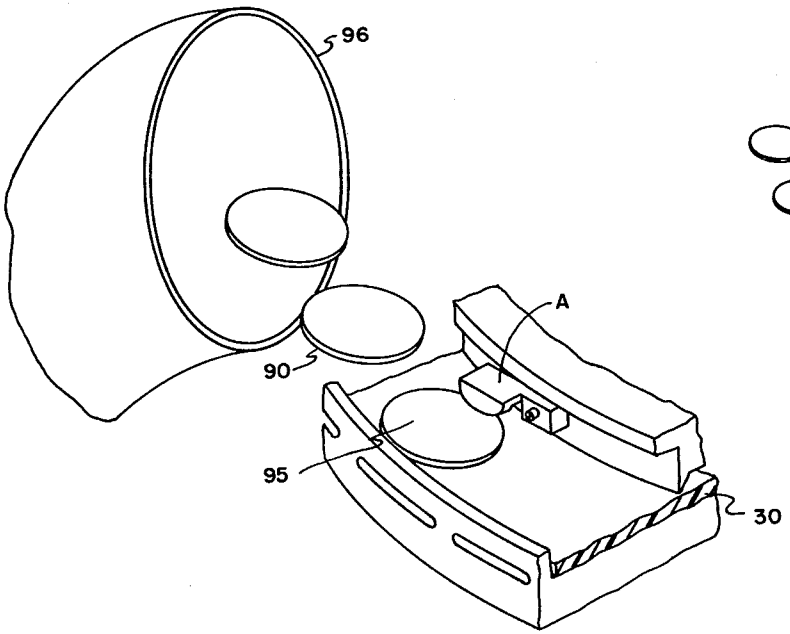
FIG. 3 is a perspective view of a portion of FIG. 2 taken along 3—3 of FIG. 1.

The largest of the coins for which the sorter is adapted to sort, such as for example a quarter 90, would be engaged, as shown in FIGS. 2 and 3 by coin depressor A and by virtue of the depression of inner edge 92, the outer edge 94 will be raised and quarters 90 and 95 would be hurled over the edge of rim 41 into tube 96, as illustrted in FIG. 3. Similarly, coin depressors B, C, and D would be positioned radially to engage the inner edge of nickels, pennies, and dimes, respectively, or any other circular members of decreasing diameter. Once the coins are sorted, they are routed via tube 96 to counting devices and after that would be bagged.

Figure 7:
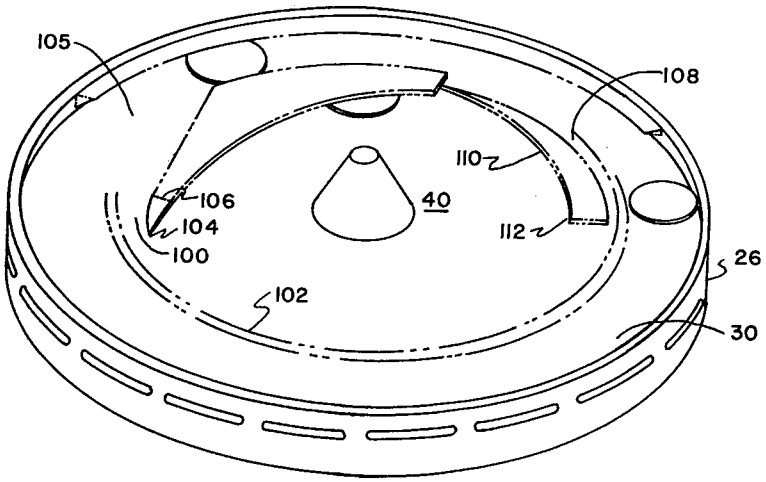
FIG. 7 is a perspective view showing the rotating disc and the relationship of it to a modification of the guide system shown in FIGS. 4 and 5.

FIG. 7 illustrates a slightly different guide structure from that shown in FIGS. 4 and 5. As shown, coins are free to exit from the center of disc 26 through a gate region 100 between guides 102 and 104 to an alignment region 105 where they are stabilized by guide 46 and then pass on to sorting station 42. Coins which are inboard of this gate region strike the inner surface 106 of guide 104 and returned to the center region of disc 26. To further this process, guide 108 is employed, and it has an inner spiral surface 110. This guide may be made adjustable to move end 112 radially to vary the inward spiral of coins to achieve a desired flow rate from the center of disc 26 to alignment region 105.

Having this disclosed our invention, what is claimed is:

1. A coin sorting machine for sorting selected size coins comprising:

a fixed mounted, vertically disposed hopper having a top entrance and a bottom exit for coins;

a rotary coin carrying disc having a top surface on which coins are free to move and positioned under and spaced from said bottom exit of said hopper and extending radially outward beyond said hopper;

means for rotating said disc in a selected direction;

at least a generally outer annular portion of said top surface of said disc being of a flexible material;

peripheral limit means comprising a raised annular region extending above and around a peripheral portion of said disc; and coin lifting means comprising a series of coin edge depressing means positioned over an outer annular segment of said disc constituting a sorting station, said coin edge depressing means being circumferentially spaced and positioned over an outer region of said disc, there being one depressing means for each denomination of coin, and each depressing means being positioned at a discrete radial distance from said peripheral limit means and above said flexible portion of said surface of said disc, and being positioned to engage and depress the radially positioned inner edge of a coin as it passes under a said depressing means, whereupon when the inner edge of a coin is depressed against said flexible material, the radially outer edge of the coin is raised, enabling it to be hurled by centrifugal force over said peripheral limit means and at a discrete angular peripheral position, enabling coins of a discrete size to be expelled at a discrete position and thereby coins to be denominationally sorter.

2. A coin sorting machine as set forth in claim 1 including coin routing means comprising a coin passageway between a region of said disc directly under the outer edge of the exit of said hopper, and said peripheral limit means for directing coins in a single file against said peripheral limit means.

3. A coin sorting machine as set forth in claim 2 wherein said outer annular portion of said top surface of said disc which is of a flexible material extends inward to at least that portion of said disc adjacent to the outer edge of the bottom exit of said hopper.

4. A coin sorting machine as set forth in claim 1 wherein each said coin depressing means comprises a fixed cam having a tapered frontal coin engaging surface.

5. A coin sorting machine as set forth in claim 1 wherein said coin depressing means comprises a horizontally journalled, rotatable, circular member.

6. A coin sorting machine as set forth in claim 5 further comprising means coupled to said circular member and in engagement with said disc for rotating said circular member.

7. A coin sorting machine as set forth in claim 3 wherein said coin capturing means comprises a plate having a downwardly tapered frontal edge, whereby engaging coins are initially depressed downward against said flexible material of said top surface of said disc and passed into an alignment region between first-named and second-named peripheral limit means.

8. A coin sorting machine as set forth in claim 7 wherein said means for blocking radial outward movement of coins comprises a portion of an inner edge of said plate.

9. A coin sorting machine as set forth in claim 8 wherein said coin routing means includes a second routing means for capturing coins in motion between said first and second peripheral limit means, and including a second plate having a tapered downwardly extending leading edge adapted to receive coins and initially depress them into the flexible material on the top surface of said disc, and having an upwardly tapered trailing edge enabling the coins to gradually rise as they pass from under said plate, exiting into said coin sorting station.

10. A coin sorting machine as set forth in claim 9 wherein there is an inwardly extending passageway inboard of said tapered leading edge of said second plate of said second capturing means, said passageway extending between said plates from an inner edge of said leading edge of said second plate into the center region of said disc, whereby a coin not engaged by said leading edge of said second plate and thus routed onto said sorting station is directed back into the center region of said disc for rerotation and recapture.

11. A coin sorting machine as set forth in claim 2 further comprising second routing means serially arranged between said first-named routing means, and said sorting station comprising second coin capturing means for capturing coins in direct engagement with said first-named peripheral limit means and holding them in a radial position in a path to said sorting station, and means for directing other coins back into a position within said second-named peripheral limit means for rerotation.

12. In combination:

a fixed mounted, vertically disposed hopper having a top entrance and a bottom exit for coins;

a rotary coin carrying disc having a top surface on which coins are free to move and positioned under and spaced from said bottom exit of said hopper and extending radially outward beyond said hopper;

means for rotating said disc in a selected direction;

at least a generally outer annular portion of said top surface of said disc being of a flexible material;

peripheral limit means comprising a raised annular region extending above and around a peripheral portion of said disc; and coin lifting means comprising at least one coin edge depressing means positioned over an outer annular segment of said disc, said coin edge depressing means being positioned at a discrete radial distance from said peripheral limit means and above said flexible portion of said surface of said disc, and being positioned to engage and depress the radially positioned inner edge of a coin as it passes under said depressing means, whereupon when the inner edge of a coin is depressed against said flexible material, the radially outer edge of the coin is raised, enabling it to be hurled by centrifugal force over said peripheral limit means and at a discrete angular peripheral position.

* * * * *